US006166308A

United States Patent [19]

Lam

[11] Patent Number: 6,166,308

[45] Date of Patent: Dec. 26, 2000

[54] GUITAR SOUND BOARD ASSEMBLY

[76] Inventor: Mitchell Lam, 685 4th Ave., San Francisco, Calif. 94118

[21] Appl. No.: 09/406,420

[22] Filed: Sep. 27, 1999

[51] Int. Cl.[7] ..... G10D 3/00

[52] U.S. Cl. ..... 84/291; 84/290

[58] Field of Search ..... 84/290, 291, 267

[56] References Cited

U.S. PATENT DOCUMENTS

| | | | |
|---|---|---|---|
| 1,768,261 | 2/1930 | Larson | 84/291 |
| 1,889,408 | 9/1932 | Larson | 84/291 |
| 3,685,385 | 8/1972 | Rendell | 84/267 |
| 3,892,159 | 7/1975 | Houtsma | 84/307 |
| 4,881,441 | 11/1989 | Larsen | 84/291 |
| 5,406,874 | 4/1995 | Witchel | 84/291 |
| 5,469,770 | 11/1995 | Taylor | 84/291 |
| 5,952,592 | 9/1999 | Teel | 84/291 |

*Primary Examiner*—Robert E. Nappi
*Assistant Examiner*—Kim Lockett
*Attorney, Agent, or Firm*—Jack Lo

[57] ABSTRACT

A guitar soundboard assembly is comprised a plurality of internal braces attached to an inner side of a soundboard for resisting warping. The soundboard is relatively thick for a longer useful life. The braces include two cantilever braces extending between opposite sides of the soundboard. Each cantilever brace is comprised of an elongated bar supported in a spaced position behind the soundboard by a pair of mounting blocks at its ends. Although the soundboard is relatively thick, the portions between the mounting blocks of the cantilever braces are free to vibrate, so that it can vibrate as much as a thinner conventional soundboard. The bases of the mounting blocks of the cantilever braces are slightly angled relative to each other to arch the soundboard forwardly for further increasing stiffness and resisting cave in. The cantilever braces are each thinner on the treble side of the soundboard than on the bass side to reduce rigidity on the treble side and compensate for the lower tension of the treble strings. Additional braces are attached to the soundboard for supporting other positions.

14 Claims, 3 Drawing Sheets

GUITAR SOUND BOARD ASSEMBLY

BACKGROUND OF THE INVENTION

1. Field of the Invention

This invention relates generally to guitars.

2. Prior Art

An acoustic guitar has a long neck attached to one end of a hollow wooden body. Nylon or steel strings are strung under great tension between the top of the neck and an opposite end of the body. The strings gradually range from thick bass strings toward the bottom of the guitar to thin treble strings toward the top of the guitar. The bass strings are under greater tension than the treble strings. The body is comprised of a front soundboard connected to a backboard by a curved side wall. The center of the soundboard is pierced by a sound hole. The soundboard is made relatively thin to vibrate in response to the vibrations of the strings to amplify the sound. Prior art soundboards generally range from about 3/32" (2.4 mm) thick to 1/8" (3.2 mm) thick.

The soundboard is reinforced by internal braces attached to its inner side to prevent it from warping and caving in under the tension of the strings. Although the braces must be stiff enough to provide support, they must still allow the soundboard to vibrate. As disclosed in Classical Guitar Construction, a book published by The Bold Strummer, Ltd., the numerous bracing designs that have been tried testify to the great difficulty in achieving a good balance between these opposing requirements. The most common braces are each attached to the soundboard along its entire length. Greater support to a thin soundboard is provided by such an arrangement. A thin soundboard must have an even wood grain across its entire surface to provide even sound qualities across its tonal range. The requirement for good quality wood with an even grain structure makes a good quality thin soundboard very expensive. Nevertheless, a good quality soundboard has a limited useful life due to its thinness.

A less common bracing arrangement disclosed on page 16 of Classical Guitar Construction includes a transverse brace with two short arches, so that the brace is attached to the soundboard at its ends, and also along a substantial length of its middle portion. The support provided by this brace is substantially the same as that of more conventional braces.

The guitars disclosed in U.S. Pat. No. 5,461,958 to Dresdener et al. and U.S. Pat. No. 3,685,385 to Rendell also include internal braces that are each attached to the soundboard along its entire length.

All prior art braces are each of the same thickness along its entire length to provide even support across the soundboard. However, since the bass and treble strings are under different tension, prior art braces provide too much support for the treble side, so that uneven tones are produced.

OBJECTS OF THE INVENTION

Accordingly, objects of the present guitar soundboard assembly are:

- to be stiff enough to resist warping and caving in;
- to be flexible enough for longer vibration decays;
- to provide good sound qualities in both the bass and treble ranges;
- to be made with a less expensive wood without sacrificing sound quality; and
- to have a longer useful life.

Further objects of the present invention will become apparent from a consideration of the drawings and ensuing description.

BRIEF SUMMARY OF THE INVENTION

A guitar soundboard assembly is comprised a plurality of internal braces attached to an inner side of a soundboard for resisting warping. The soundboard is relatively thick for a longer useful life. The braces include two cantilever braces extending between opposite sides of the soundboard. Each cantilever brace is comprised of an elongated bar supported in a spaced position behind the soundboard by a pair of mounting blocks at its ends. Although the soundboard is relatively thick, the portions between the mounting blocks of the cantilever braces are free to vibrate, so that it can vibrate as much as a thinner conventional soundboard. The bases of the mounting blocks of the cantilever braces are slightly angled relative to each other to arch the soundboard forwardly for further increasing stiffness and resisting cave in. The cantilever braces are each thinner on the treble side of the soundboard than on the bass side to reduce rigidity on the treble side and compensate for the lower tension of the treble strings. Additional braces are attached to the soundboard for supporting other positions.

DRAWING REFERENCE NUMERALS

| | |
|---|---|
| 10. Soundboard | 11. Sound Hole |
| 12. Cantilever Brace | 13. Elongated Bar |
| 14. Mounting Block | 15. Mounting Block |
| 16. End | 17. End |
| 18. Thicker Section | 19. Bass Side |
| 20. Thinner Section | 21. Treble Side |
| 22. Diagonal Top Corner Brace | 23. Diagonal Bottom Corner Brace |
| 24. Center Transverse Brace | 25. Longitudinal Brace |

DETAILED DESCRIPTION OF THE INVENTION

Figure 1:
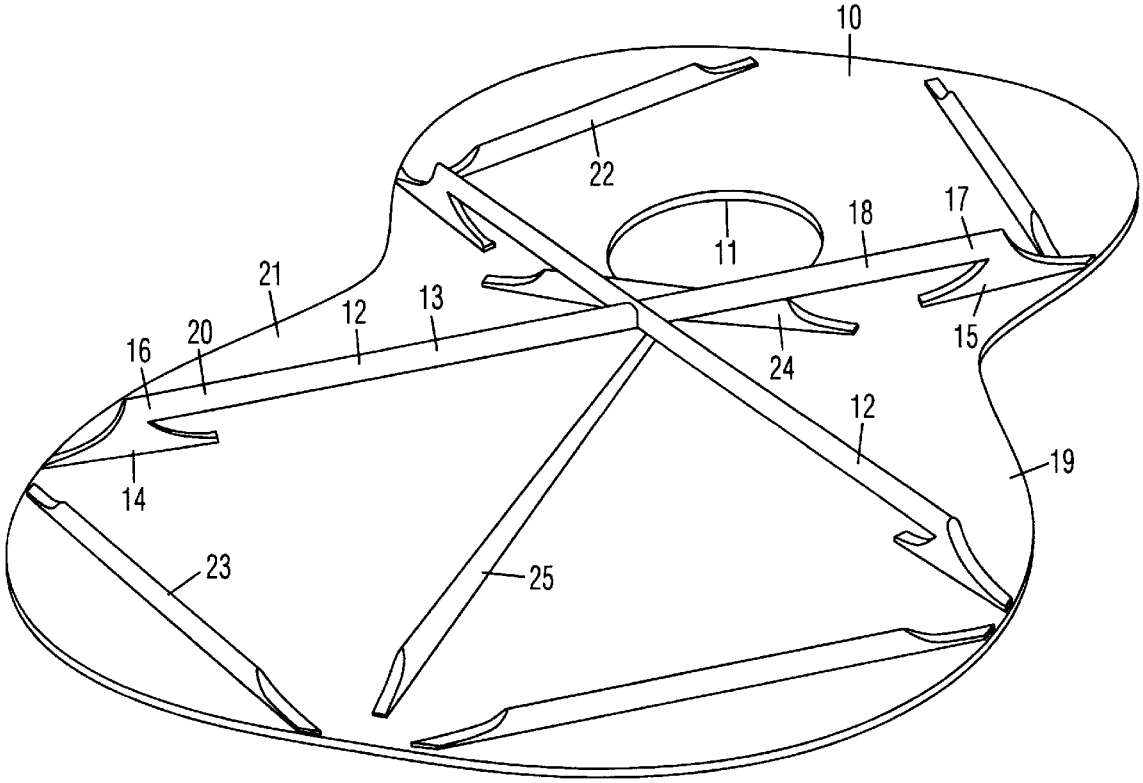
FIG. 1 is a rear perspective view of the present guitar soundboard assembly.
Figure 2:
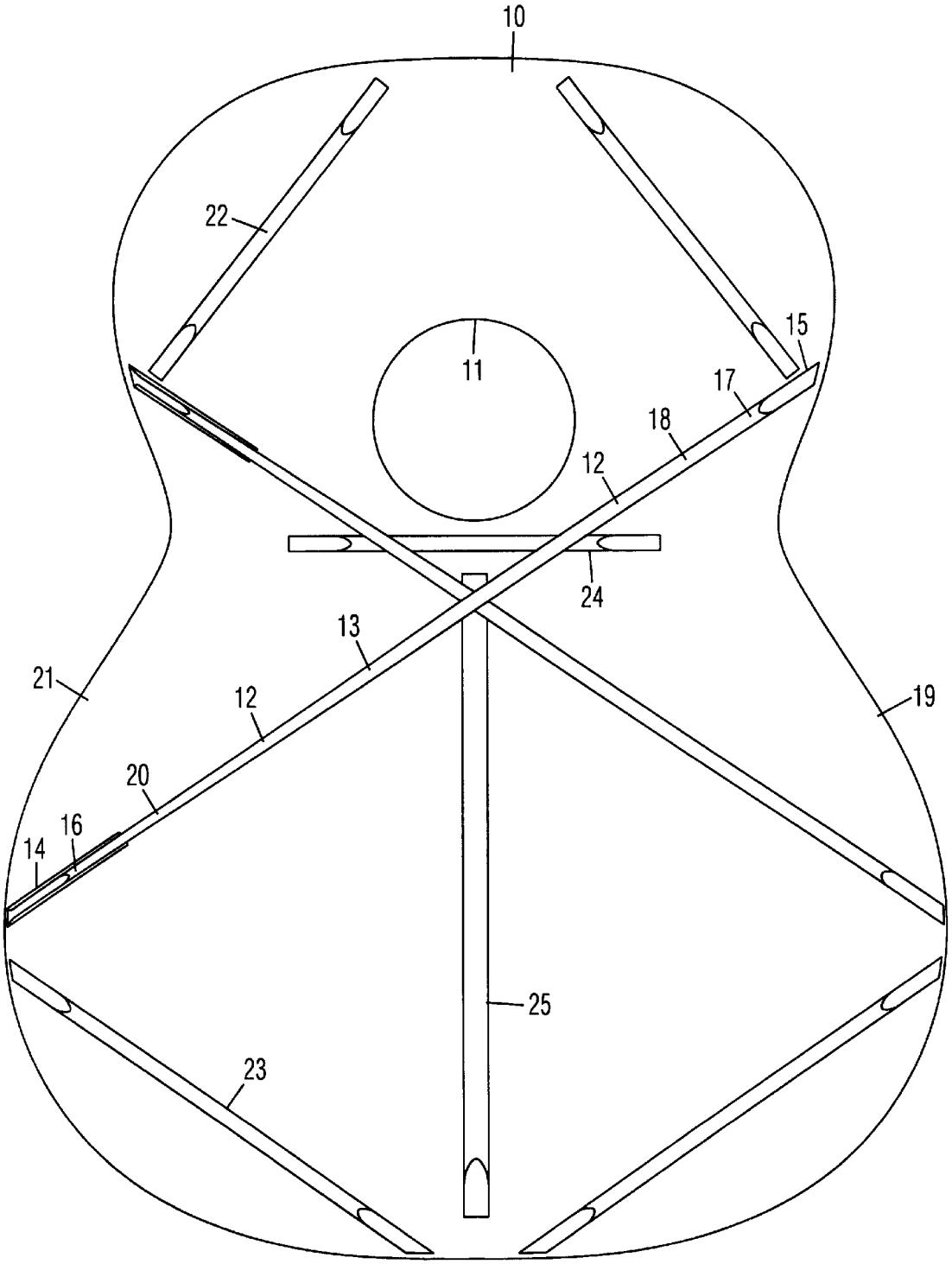
FIG. 2 is a rear view thereof.

FIGS. 1–2:

A preferred embodiment of the present guitar soundboard assembly is shown in a rear perspective view in FIG. 1 and a rear view in FIG. 2. It is comprised of a soundboard 10 pierced by a sound hole 11. Soundboard 10 is preferably about 1/8" (3.2 mm) to 7/32" (5.6 mm) thick for greater durability and a longer useful life. It may be made with lower quality wood with relatively uneven grain for reduced cost. The lower quality sound of such a wood is compensated by the increased thickness.

According to conventional teachings in the art, a thicker soundboard vibrates less than a thinner one. However, soundboard 10 vibrates as much as a thinner soundboard because it is primarily reinforced by a pair of cantilever braces 12. Each cantilever brace 12 is comprised of an elongated bar 13 supported in a spaced position behind soundboard 10 by a pair of mounting blocks 14 and 15 at its respective ends 16 and 17. The portion of soundboard 10 between mounting blocks 14 and 15 is free to vibrate to compensate for its increased thickness. Although elongated bar 13 is straight in this example, it may be curved instead. Cantilever braces 12 are connected between opposite sides of soundboard 10, preferably in a cross, and the intersection between them is formed by mating notches (not shown) on bars 13. Alternatively, cantilever braces 12 may be connected between other positions on soundboard 10, such as between the top and bottom ends, or between the lower end of sound hole 11 and the bottom of soundboard 10.

Good sound quality is provided by the soundboard assembly in the bass as well as the treble. As clearly shown in FIG. 2, bar 13 is preferably gradually tapered from thicker end 17 to narrower end 16. A thicker section 18 of bar 13 is on a bass side 19 of soundboard 10 where the higher tension bass strings are positioned, so that more rigidity is provided where more rigidity is needed. A thinner section 20 of bar 13 is on a treble side 21 of soundboard 10 where the lower tension treble strings are positioned, so that less rigidity is provided where less rigidity is needed. As a result, soundboard 10 is provided with just the right amount of rigidity on bass side 19 as well as treble side 21 for even sound quality across its tonal range.

Other braces are also attached to soundboard 10 for preventing warping and controlling tone. They include a pair of diagonal top corner braces 22 at the top corners, and a pair of longer diagonal bottom corner braces 23 at the bottom corners. They also include a center transverse brace 24 extending partially across soundboard 10 just below sound hole 11, and a center longitudinal brace 25 extending from a bottom end of soundboard 10 to sound hole 11. Although in this example braces 22–25 are conventional braces which are attached to soundboard 10 along their entire lengths, they may also be cantilever braces too.

Figure 3:
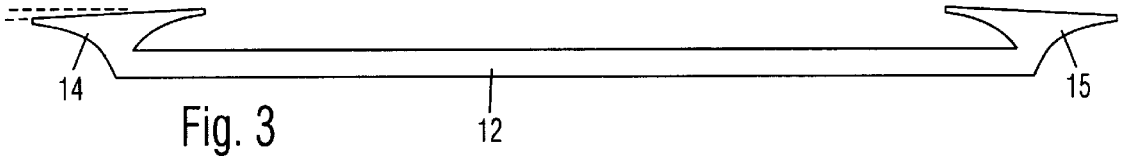
FIG. 3 is a side view of a cantilever brace thereof.
Figure 4:
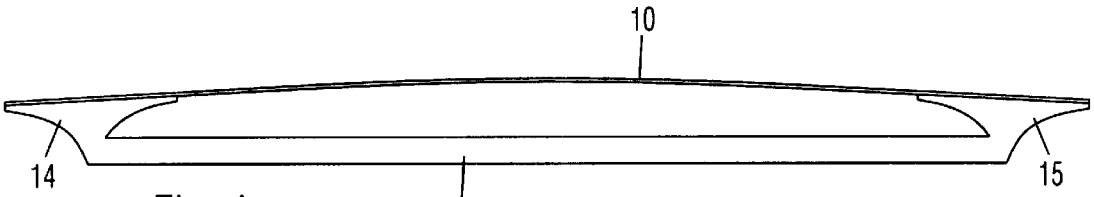
FIG. 4 is a side view of the cantilever brace attached to a soundboard thereof

FIGS. 3–8:

In FIG. 3, one of braces 12 is shown in a side view. The bases of its mounting blocks 14 and 15 are angled outwardly, preferably about 2–3 degrees. When soundboard 10 is attached to the bases of mounting blocks 14 and 15, it is supported in a forwardly bowing arch for even greater resistance to warping and caving in, as shown in FIG. 4.

Figure 5:
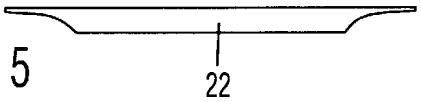
FIG. 5 is a side view of a top corner brace thereof.
Figure 6:
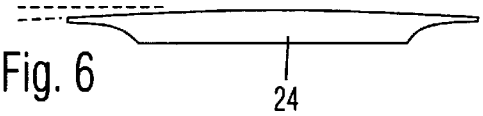
FIG. 6 is a side view of a transverse brace thereof.
Figure 7:
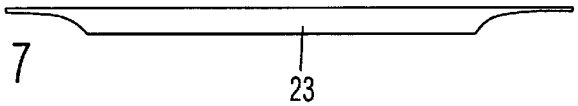
FIG. 7 is a side view of a bottom corner brace thereof.
Figure 8:
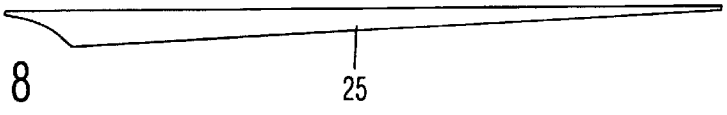
FIG. 8 is a side view of a longitudinal brace thereof.

FIG. 5 is a side view of a top corner brace 22, which preferably has parallel inner and outer edges. FIG. 6 is a side view of transverse brace 24, which preferably has a base that is angled outwardly on each side, preferably about 2–3 degrees, to support the soundboard in the forwardly bowing arch. FIG. 7 is a side view of a bottom corner brace 23, which preferably has parallel inner and outer edges. FIG. 8 is a side view of longitudinal brace 25, which preferably has a wider lower end, and a gradually tapering upper end for reduced support nearer the center of the soundboard for more vibrations. All braces preferably have filleted ends and rounded top edges.

SUMMARY AND SCOPE

Accordingly, the present soundboard assembly is stiff enough to resist warping. It is flexible enough for longer vibration decays. It provides good sound qualities in both the bass and treble ranges. It is made with a less expensive wood without sacrificing sound quality. It also has a longer useful life.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A guitar soundboard assembly, comprising:

a soundboard; and a cantilever brace attached to an inner surface of said soundboard only at opposite ends of said cantilever brace;

wherein said soundboard is disconnected and spaced from any and all cantilever braces except at said opposite ends for increasing vibrations in said soundboard.

2. The guitar soundboard assembly of claim 1, wherein said cantilever brace is connected diagonally across a center portion and between opposite sides of said soundboard, so that said cantilever brace is spaced from said soundboard generally across a width of said soundboard for enabling more vibrations.

3. The guitar soundboard assembly of claim 1, wherein said soundboard is about ⅛" (3.2 mm) to 7⁄32" (5.6 mm) thick for improved sound quality and greater durability.

4. The guitar soundboard assembly of claim 1, wherein bases of said opposite ends of said cantilever brace are angled relative to each other to arch said soundboard away from said cantilever brace for further increasing stiffness and resisting cave in.

5. The guitar soundboard assembly of claim 1, wherein said cantilever brace is thinner on a treble side of said soundboard and thicker on a bass side of said soundboard to reduce rigidity on said treble side relative to said bass side, thus compensating for different tensions applied to said soundboard by treble strings and bass strings.

6. The guitar soundboard assembly of claim 1, further including a pair of diagonal top corner braces attached generally across top corners of said soundboard, a pair of diagonal bottom corner braces attached generally across bottom corners of said soundboard, a center transverse brace extending partially generally across a center portion of said soundboard, and a center longitudinal brace extending from a bottom end of said soundboard generally to said center portion of said soundboard.

7. A guitar soundboard assembly, comprising:

a soundboard; and a cantilever brace comprising only two mounting blocks attached to opposite sides of said soundboard on an inner surface thereof, and an elongated bar connected between said mounting blocks and supported in a spaced position behind said soundboard;

wherein said soundboard is spaced and disconnected from any and all cantilever braces except at said opposite ends for increasing vibrations in said soundboard.

8. The guitar soundboard assembly of claim 7, wherein said soundboard is about ⅛" (3.2 mm) to 7⁄32" (5.6 mm) thick for improved sound quality and greater durability.

9. The guitar soundboard assembly of claim 7, wherein bases of said mounting blocks are angled relative to each other to arch said soundboard away from said elongated bar for further increasing stiffness and resisting cave in.

10. The guitar soundboard assembly of claim 7, wherein said elongated bar is thinner on a treble side of said soundboard and thicker on a bass side of said soundboard to reduce rigidity on said treble side relative to said bass side, thus compensating for different tensions applied to said soundboard by treble strings and bass strings.

11. The guitar soundboard assembly of claim 7, further including a pair of diagonal top corner braces attached generally across top corners of said soundboard, a pair of diagonal bottom corner braces attached generally across bottom corners of said soundboard, a center transverse brace extending partially generally across a center portion of said soundboard, and a center longitudinal brace extending from a bottom end of said soundboard generally to said center portion of said soundboard.

12. A guitar soundboard assembly, comprising:

a soundboard; and a cantilever brace comprising only two mounting blocks attached to opposite sides of said soundboard on an inner surface thereof, and an elongated bar connected between said mounting blocks and supported in a spaced position behind said soundboard, an entire portion of said elongated bar between said mounting blocks being spaced from said soundboard, thereby said elongated bar is spaced from said soundboard generally across a width of said soundboard for enabling more vibrations;

said bases of said mounting blocks being angled relative to each other to arch said soundboard away from said elongated bar for further increasing stiffness and resisting cave in;

said elongated bar being thinner on a treble side of said soundboard and thicker on a bass side of said soundboard to reduce rigidity on said treble side relative to said bass side, thus compensating for different tensions applied to said soundboard by treble strings and bass strings.

13. The guitar soundboard assembly of claim 12, wherein said soundboard is about ⅛" (3.2 mm) to 7⁄32" (5.6 mm) thick for improved sound quality and greater durability.

14. The guitar soundboard assembly of claim 12, further including a pair of diagonal top corner braces attached generally across top corners of said soundboard, a pair of diagonal bottom corner braces attached generally across bottom corners of said soundboard, a center transverse brace extending partially generally across a center portion of said soundboard, and a center longitudinal brace extending from a bottom end of said soundboard generally to said center portion of said soundboard.

* * * * *